US005378504A

United States Patent [19]

Bayard et al.

[11] Patent Number: 5,378,504

[45] Date of Patent: Jan. 3, 1995

[54] METHOD FOR MODIFYING PHASE CHANGE INK JET PRINTING HEADS TO PREVENT DEGRADATION OF INK CONTACT ANGLES

[76] Inventors: Michel L. Bayard, 1088 SW. Westwood Dr., Portland, Oreg. 97201; Donald P. Chitwood, 4220 SW. Freeman St., Portland, Oreg. 97219

[21] Appl. No.: 105,267

[22] Filed: Aug. 12, 1993

[51] Int. Cl.[6] ..... B05D 3/02

[52] U.S. Cl. ..... 427/377; 347/45; 427/385.5

[58] Field of Search ..... 346/1.1, 140 R; 427/385.5, 388.6, 377; 347/45

[56] References Cited

U.S. PATENT DOCUMENTS

| | | | |
|---|---|---|---|
| 3,946,398 | 3/1976 | Kyser et al. | 346/1 |
| 4,296,421 | 10/1981 | Hara et al. | 346/140 |
| 4,343,013 | 8/1982 | Bader et al. | 346/140 |
| 4,368,476 | 1/1983 | Uehara et al. | 346/140 |
| 4,533,569 | 8/1985 | Bangs | 427/154 |
| 4,623,906 | 11/1986 | Chandrashekhar et al. | 346/140 |
| 4,643,948 | 2/1987 | Diaz et al. | 428/422 |
| 4,728,393 | 3/1988 | Peel | 162/29 |
| 4,751,532 | 6/1988 | Fujimura et al. | 346/140 |
| 4,779,099 | 10/1988 | Lewis | 346/1.1 |
| 5,119,116 | 6/1992 | Yu | 346/140 R |
| 5,136,310 | 8/1992 | Drews | 346/140 R |
| 5,208,606 | 5/1993 | Klein et al. | 345/1.1 |
| 5,212,496 | 5/1993 | Budeshe et al. | 428/447 X |

FOREIGN PATENT DOCUMENTS

| | | |
|---|---|---|
| 0359365 | 7/1989 | European Pat. Off. . |
| 0087358 | 3/1989 | Japan . |

OTHER PUBLICATIONS

Preventing Clogging of Small Orifices in Objects Being Coated, Hildenbrand et al., IBM TDB, vol. 15, No. 9, p. 2899 (Feb. 1973).

Highly Non-Wettable Surface of Plasma Polymer Vapor Deposition of Tetrafluoroethylene, Washo, IBM TDB, V. 26, No. 4, pp. 2074–2075, (Sep. 1983).

Effect of Refill Dynamics on Frequency Response and Print Quality in a Drop-On-Demand Ink-Jet System, Torpey, The Third International Congress on Advances in Non-Impact Printing Technologies, San Francisco, Calif., pp. 89–91 (Aug. 1986).

Hydrophobic Pigment Wetting in Aqueous Coating Systems, Vash et al., EIM8210-045128, pp. 507–510 (Aug. 1981).

Drop-On-Demand Ink Jet Printing at High Print Rates and High Resolution, Lee et al., The SPSE First International Congress, Venice, Italy, Jun. 22–26, 1981, pp. 1059–1070.

Dynamic Behavior of The Nozzle/Meniscus Fluid System in a Drop-On-Demand Ink-Jet Orifice, Lee, SID 86 Digest, pp. 98–99.

Wettability of Perfluorocarbon Polymer Films: Effect of Roughness, Allan et al., Journal of Polymer Science, vol. XXXIX, pp. 1–8 (1959).

New Way to Cooat Plastics and Metals, Gorrell, Plastics Technology, pp. 45–46 (Oct. 1964).

Low Surface Energy Fluoro-Epoxy Coating for Drop-On-Demand Nozzles, Anger et al., IBM TDB, vol. 26, No. 1, Jun. 1983, p. 431.

Nozzles for Ink Jet Printers, Crowley et al., IBM TDB, vol. 25, No. 8, Jan. 1983, p. 4371.

Ink-Jet Printing, Döring, Philips Tech. Rev. 40, No. 7, pp. 192–198 (1982).

Coated Jets Technology Transfer, Le et al., ARL Technical Report No. TR-IRL/HCR-84-002, Sep. 21, 1984.

The Effect of Surface Wetting at the Drop Forming Aperture in an Air-Assisted Drop-On-Demand Ink Jet, Le et al., Proceedings from Electronics Imaging '85 Conference, Boston, Mass. p. 104–(Oct. 1985).

*Primary Examiner*—Michael Lusignan

[57] ABSTRACT

A method for modifying a phase change ink jet head by applying a non-wetting material to the discharge surface is provided such that an ink contact angle between about 80° and about 90° is maintained on the discharge surface after continued exposure to molten phase change inks. Furthermore, the method provided ensures that the layer of non-wetting coating material does not chip or wear off during the normal operation of the ink jet printer. In this way, the ink jet printer is capable of accurate placement of phase change ink drops without increased surface wetting and off-axis shooting that traditionally occurs after continued use.

41 Claims, 2 Drawing Sheets

METHOD FOR MODIFYING PHASE CHANGE INK JET PRINTING HEADS TO PREVENT DEGRADATION OF INK CONTACT ANGLES

BACKGROUND OF THE INVENTION

1. Field of the Invention

This invention relates to ink jet print heads and more specifically to a method for modifying ink jet print heads to prevent degradation of ink contact angles after continued exposure to molten phase change inks.

2. Background Art

Ink jet printers having one or more ink jet print heads with one or more ink jetting nozzles in each printhead for projecting drops of ink to generate graphic images and text have become increasingly popular. To form color images, ink jet printers with multiple ink jetting nozzles are used, with each nozzle being supplied with ink of a different color. These colored inks are then applied, either alone or in a combination, to the printing medium to make a finished color print. Typically, all of the colors needed to make the print are produced from combinations of cyan, magenta, and yellow inks. Black ink may also be added to the above ink combination when the combination of the cyan, magenta and yellow does not produce a true enough black, or when text is being printed.

Various systems and methods are known for producing printed images with aqueous based inks. A serious problem in printing images with ink jets that use aqueous based inks is wetting of the ink discharge surface. Wetting of the discharge surface is caused by a low ink contact angle, and typically ink contact angles of greater than 90° are sought. The ink contact angle is the angle formed by the tangent to the ink drop at the ink discharge surface and the ink discharge surface. The ink contact angle is created by a difference in surface energies between the ink composition and the material defining the discharge surface. The larger the ink contact angle, the less wetting of the discharge surface that occurs.

The presence of ink deposits due to surface wetting on the ink discharge surface surrounding the drop discharge nozzle causes several problems. The most severe problem is that the wetted surface eventually degrades the ink contact angle between the ejecting ink droplet and the discharge surface such that no ink is discharged at all. This becomes a more prevalent problem as the rate of ink ejection is increased. Another problem caused by wetting of the discharge surface is that the ink deposits cause non-uniform ink ejection or off-axis shooting. Non-uniform ink ejection causes poor quality of the printed image. Still another problem caused by wetting of the discharge surface is that a color ink jet print head may have nozzles of different colors adjacent to each other. As the discharge surface wets, the colors mix and the ink droplets become contaminated, which also leads to poor quality of the final printed image.

Various methods or approaches have been developed which treat the discharge surface of an ink jet system with non-wetting materials thereby preventing deposits of ink from spreading out across the discharge surface from the drop discharge nozzles of the ink jet system. This is accomplished by using a coating material which has a very low surface energy with respect to the surface energy of the ink being used. The difference in surface energy causes the ink contact angle between the coated discharge surface and the ink to be greater than when no coating is used. With a larger ink contact angle, the ink drop that forms is more likely to be completely ejected, thus less ink is left on the discharge surface to begin the wetting process. Some examples of these various methods and approaches for treating the discharge surface of an ink jet head are described below.

In U.S. Pat. No. 4,533,569, Aug. 6, 1985, of Bangs for PROCESS PREVENTING AIR BUBBLE LOCK IN INK JET NOZZLES, the interior surface area of a glass nozzle is cleaned with hydrofluoric acid and then coated with a blocking agent such as ethylene glycol, glycerine and the like. Anti-wetting compounds, such as long chain anionic non-wetting agents, are applied to the fluid nozzles after ionic pretreatment to improve ink drop quality.

U.S. Pat. No. 4,623,906, Nov. 18, 1986 of Chandrashekhar et al. for STABLE SURFACE COATING FOR INK JET NOZZLES, describes a three-layer coating for glass or silicon ink jet nozzles comprising silicon nitride and/or aluminum nitride.

In U.S. Pat. No. 4,343,013, Aug. 3, 1982, of Bader et al. for NOZZLE PLATE FOR INK JET PRINT HEAD, the nozzle plate of an ink jet printer, which is made of glass, is coated with a material which is non-wetting relative to the aqueous characteristics of the ink composition. Compositions such as tetrafluoroethylene or certain silicone based materials are useful for this purpose since they have these aforementioned non-wetting characteristics.

A liquid repellant film layer of a fluorosilicon non-wetting compound is provided on the surface area surrounding the jet nozzle in U.S. Pat. No. 4,368,476, Jan. 11, 1983, Uehara et al. for INK JET RECORDING HEAD.

In U.S. Pat. No. 4,643,948, Feb. 17, 1987, of Diaz et al. for COATINGS FOR INK JET NOZZLES, an ink jet nozzle plate is coated with a non-wetting film of a partially fluorinated alkyl silane and a perfluorinated alkane, respectively.

A nozzle plate of the electrostatic ink jet printer is polished to a mirror finish and then is completely coated with a thin layer of Teflon® resin in U.S. Pat. No. 4,728,393. However, in this case, the Teflon® coating is employed for electrostatic control, not for ink drop formation. Ink drop formation is facilitated by the air-assist and mesa mechanisms. For this reason the ink jet would work without the Teflon® coating.

In U.S. Pat. No. 3,946,398, Mar. 23, 1976, of Kyser et al. for METHOD AND APPARATUS FOR RECORDING WITH WRITING FLUIDS AND DROP PROJECTION MEANS THEREFOR, an ink contact angle of greater than 90° between the ink and the drop ejection surface is desired to prevent ink wetting. This angle is obtained by using aqueous inks and by coating the drop ejection surface with a Teflon® coating. However, no method for applying the Teflon® coating is described.

An article related to application of a fluorocarbon polymeric film, "Highly Non-Wettable Surface Plasma Polymer Vapor Deposition of Tetrafluoroethlyene" by B. D. Washo, in the IBM TDB, Vol. 26, No. 4, Pg. 2074, describes the benefits of having a toughened surface to maximize contact angles and thus reduce wetting when contact angles greater than 90° exist. Another article relates to the application of a Teflon® layer to a surface surrounding a nozzle. This article, "Preventing Clogging of Small Orifices in Objects Being Coated" by W. W. Hildenbrand and S. A. Manning, in the IBM TDB, Vol. 15, No. 9, Pg. 2899 (February 1973), describes how to prevent the clogging of a nozzle by ejecting nitrogen through the nozzle so that the nitrogen flows out of the nozzle while the Teflon ® layer is being sprayed on to the surface.

However, all of the above mentioned references relate to the problems encountered with the use of aqueous-based inks. In a different ink jet printing technology, non-aqueous, phase change inks have been employed in place of aqueous-based inks in ink jet systems. A phase change ink is solid at room temperature but becomes liquid at the elevated operating temperature of the ink jet so that it may be jetted as liquid drops in a predetermined pattern. The jetted ink then solidifies and forms the image. The problems caused by wetting of the drop ejection surface described above in relation to aqueous-based inks occur with phase change inks as well. However, there are a few major differences between phase change inks and aqueous-based inks that cause problems with regard to discharge surface wetting that are not solved by the aforementioned teachings.

First, after continued exposure to the molten ink at the elevated operating temperatures of a phase change ink jet head, the anti-wetting properties of the non-wetting surface start to degrade and even the 60° contact angles become difficult to maintain. As the ink contact angle decreases, wetting of the surface becomes more prevalent. Eventually, the ink contact angle decreases to the point where the wetting of the discharge surface causes the ink jet nozzle to fail to eject an ink drop. Furthermore, any non-wetting material within the ink jet nozzle causes off-axis shooting, and may even prevent the jetting of ink from the nozzle. The off-axis shooting typically occurs because the difference in surface energy between the ink composition and the non-wetting material creates a large ink contact angle within the nozzle.

Second, because the ink contact angle with phase change ink is smaller than with aqueous-based ink, more wetting of the discharge surface occurs. Therefore, the type of process for cleaning a phase change ink jet head is more destructive to a coating material that is applied to the discharge surface than the cleaning processes typically used with aqueous-based ink jet printers. It has been noted that after repeated cleaning, the coating material starts to wear off of the discharge surface. Furthermore, any grooves, valleys, or gross differences in thicknesses on the discharge surface allow wetted ink to gather. If these differences are severe enough, ink is left on the discharge after the cleaning process.

Therefore, a method is needed for applying an anti-wetting coating to an ink jet head such that the ink contact angles do not degrade after continued exposure to molten phase change inks at the high operating temperature of such a print head. Furthermore, there is a need for a method of applying an anti-wetting coating to a phase change ink jet head such that no coating material remains within the nozzle of the ink jet head. Still further, a method is needed for applying an anti-wetting coating to a phase change ink jet head such that the coating does not chip off or wear off the surface during operation of the ink jet printer. Still further, there is a need for a method of applying an anti-wetting coating to a phase change ink jet head such that the surface is smooth. These problems are solved by the method of the present invention.

SUMMARY OF THE INVENTION

It is an object of this invention to provide a method for modifying a phase change ink jet head such that accurate ink drop placement can be made even after continued exposure to the elevated operating temperatures.

It is another object of this invention to provide a method for applying a durable layer of coating material to the discharge surface of a phase change ink jet head.

It is a feature of the current invention that a coating material is applied to a phase change ink jet head after exposing the discharge surface to a hydrogen environment.

It is another feature of the current invention that an adhesion promoting layer may be applied to the surface of the ink jet head before a coating material is applied.

It is another feature of the current invention that a coating material is applied to a phase change ink jet head having at least one ink jet nozzle with a meniscus coating system such that large, unbroken molecular chains of the coating material are applied to the discharge surface.

It is another feature of the current invention that a coating material is applied to a phase change ink jet head having at least one ink jet nozzle with a meniscus coating system such that the surface of the coating material is smooth.

It is another feature of the current invention that sufficient gas pressure is applied within the ink jet head during the coating process of the discharge surface such that the coating material does not flow into the ink jet nozzle, but not a great enough gas pressure to allow the gas to escape through the ink jet nozzle and cause bubbling in the coating material.

It is still another feature of the current invention that the coating material is cured at a temperature above those recommended by the manufacturer of the coating material. Curing at the decomposition temperature decomposes all of the thin layer of coating material within the ink jet nozzle. Starting the decomposition process on the thick layer of coating material on the discharge surface yields better adhesion of the coating material to the discharge surface than when lower temperatures are used.

It is an advantage of the current invention that the ink drop performance characteristics of an ink jet nozzle do not degrade after continued exposure to the molten phase change ink at the elevated operating temperatures of the ink jet head, thus allowing for accurate and consistent ink drop placement.

It is still another advantage of the current invention that the surface of the coating material applied to the discharge surface is smooth so it may be completely wiped of all ink during a cleaning process.

It is still another advantage of the current invention that the coating material adheres to the discharge surface after exposure to the operating environment of an ink jet head.

It is still another advantage of the current invention that the times to modify and the costs to modify an ink jet head with a coating material have been reduced.

These and other objects, features and advantages are obtained in the method of the present invention that applies a smooth layer of non-wetting coating material to the discharge surface of a phase change ink jet head after exposing the surface to a hydrogen environment to make the surface reactive to the coating material. The coating material is applied with a meniscus coating system while applying an air pressure from within the ink jet nozzle to counter any capillary force that draws the coating material into the ink jet nozzle. The coating material is then blown out of the ink jet nozzle by a second air pressure after the smooth layer has been laid upon the discharge surface. Finally, the coated discharge surface is cured at a temperature greater than recommended by the manufacture of the coating material to promote decomposition of the coating material. Decomposing the coating material serves two purposes. First, the very thin layer of coating material that remains in the ink jet nozzle is completely decomposed. Second, by starting decomposition of the thicker layer of coating material on the discharge surface, adhesion to the discharge surface is enhanced.

BRIEF DESCRIPTION OF THE DRAWING

The foregoing and other objects, features and advantages of the invention will become more readily apparent from the following detailed description of a preferred embodiment which proceeds with reference to the accompanying drawings wherein.

DESCRIPTION OF THE PREFERRED EMBODIMENTS

Figure 1:
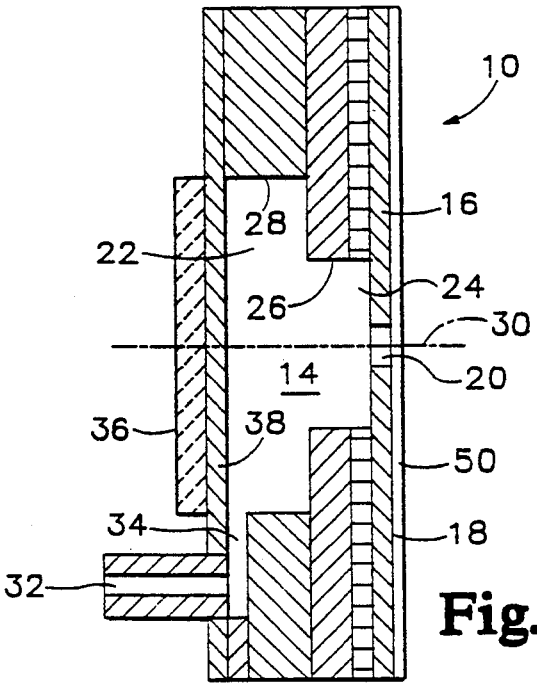
FIG. 1 is a vertical sectional view of an ink jet head modified in accordance with the present invention.

Referring now to FIG. 1, an ink jet head body indicated generally by the numeral 10 for printing with a phase change ink composition is depicted. The ink jet head body 10 includes a single compartment ink chamber 14. The ink chamber 14 is enclosed by a plate 16 which forms a chamber wall. The outer portion of the nozzle plate 16 forms a discharge surface 18. An external ink jet drop discharge nozzle 20 defined by nozzle plate 16, which forms the surrounding area for discharge nozzle 20, passes from the ink chamber 14 to the exterior of the ink jet head body 10. Although a single nozzle 20 can be provided in the nozzle plate 16, a plurality of discharge nozzles and associated ink chambers are preferably furnished. Ink chamber 14, comprised of sections 22 and 24, is of generally circular cross sectional configuration, but could also be of any polygonal cross sectional configuration. Section 24 is positioned adjacent to the wall 16 and the external ink nozzle 20, and is bounded by an interior wall 26 of ink jet head body 10. Section 22 is of greater diameter than section 24, and is bounded by an interior wall 28. The sections 22 and 24 as depicted are, but need not be, symmetrical about the axis 30.

A melted phase change ink is delivered to an ink receiving inlet 32, flows through an ink passageway 34, and fills the ink chamber 14 within ink jet head body 10. The end of ink chamber 14 opposite to external ink nozzle 20 is closed by a flexible membrane 38, such as of stainless steel. A piezoelectric ceramic disc 36, metalized on both sides and bonded to membrane 38, is one form of a pressure pulse generating actuator. However, other configurations using piezoelectric ceramics may be used herein. In response to electrical pulses applied across the piezoelectric disc, a pressure pulse is generated in ink chamber 14. This causes the ejection of an ink drop from the ink external nozzle 20. Ink drops are propelled towards a receiving medium where they create the desired printed image.

The discharge surface 18 of the nozzle plate 16 has a layer of coating material 50 selectively applied to the ink jet head in the area surrounding the discharge nozzle 20 for the purpose of preventing substantial surface wetting of the surrounding area by the drops of the phase change ink composition being discharged from the nozzle 20.

Through the use of the coating material 50, surface wetting is substantially decreased and the contact angle of the ink composition on the coating is substantially increased. This is due to the difference in surface energies between the phase change ink and the coating material 50. Typically, the contact angle is measured using the procedure described in ASTM D724-45. Furthermore, the contact angle is substantially maintained on prolonged exposure of the surrounding area to the phase change ink composition at the phase change ink operating temperature, preferably of at least about 70° C., more preferably of at least about 100° C., and most preferably of at least about 150° C. Thus, the contact angle of the ink composition produced by employing the present invention with respect to the coating material 50 is preferably maintained at least at about 50°, more preferably maintained at least at about 70°, and most preferably maintained at least at about 80°. Coating materials were evaluated by measuring the contact angle of the phase change inks after bubble testing the coating materials at 150° C. for at least one week. Bubble testing is performed by immersing the coated surface in molten ink which is having air bubbled through it for preferably more than 24 hours, and more preferably for more than 84 hours, and most preferably for more than 168 hours. The angle between a given phase change ink and coating material was measured with a goniometer manufactured by Rame-Hart, Inc. of Mountain Lakes, N.J., bearing Model No. 100-00-115.

The material generally employed as the coating layer 50 is a fluorinated polymeric material having the requisite ink contact angle described above. The fluorinated polymeric material of choice is the Du Pont Company, Wilmington, Del., trademarked Teflon® polymers, particularly Teflon® AF (amorphous perfluorodioxole copolymer), or a solution of Teflon® AF in a fluorinert solvent such as FC-40 or FC-75 from 3M Company, St. Paul, Minn., or the like.

First, the discharge of the ink jet head is exposed to a hydrogen environment at temperatures preferably at least about 500° C., and more preferably at least about 800° C., and most preferably at least about 1150° C. The discharge surface is exposed to the hydrogen preferably for at least about 50 minutes, and more preferably for at least about 80 minutes, and most preferably for at least about 110 minutes. Because the nozzle plate is preferably made from a metal, and most preferably made from stainless steel, the exposure to the hydrogen environment causes the discharge surface of the nozzle plate to be reactive to the coating material, thus when the coating is applied it adheres better to the discharge surface. Adhesion is even greater if an adhesion promoting material is applied to the discharge surface before applying the coating material. In conjunction with the preferred coating material, a preferred adhesion promoting layer would be a polyimide such as Du Pont 2550 from the Du Pont Company, Wilmington, Del., or a polyetherketone.

Second, the coating material 50 is applied to the discharge surface 18. A layer of coating material of preferably between about 4000 Å and about 1000 Å, and more preferably between about 3500 Å and about 1000 Å, and most preferably between about 3000 Å and about 1000 Å has been found to perform as desired.

Although various methods exist for applying the coating material 50 to the discharge surface 18 such as thermal evaporation, dip, spray, roller coating, or spin coating, the preferred method is using a meniscus coating system such as the CAVEX PM4000 from Specialty Coating Systems, Inc., Acushnet, Mass. Meniscus coating offers several benefits over other methods of coating. First, meniscus coating ensures that large, unbroken molecular chains of the coating material are applied to the discharge surface. During a process such as thermal evaporation, for example, the molecular bonds of the coating material are broken in places, and smaller chains of the coating material get applied to the discharge surface. With exposure to molten phase change ink, the surface energy of the coating material made of broken chains rises, thus the ink contact angle degrades. Second, methods other than meniscus coating leave artifacts of the application method in the surface of the coating material. For example, a roller will leave valleys the full length of the discharge surface 18, and spraying leaves bumps where the sprayed drops have hit the surface. Furthermore, the meniscus coating process can be more easily integrated into a production line. The process is quicker than other application methods,and the equipment needed is less expensive.

Meniscus coating provides a layer of coating material with a very smooth surface of unbroken molecular chains. The large, unbroken molecular chains allow the coating material to maintain its non-wetting characteristics even with continued exposure to the elevated operating temperatures of a phase change ink jet head. Therefore, the ink contact angles do not degrade.

Furthermore, the smooth surface of coating material deposited by the meniscus coating system allows for thorough cleaning of the discharge surface during a purge process or cleaning cycle of the ink jet printer. A decrease in the number and severity of grooves and valleys on the discharge surface makes it less likely that ink will gather in areas that are inaccessible to the cleaning process.

However, meniscus coating entails passing the discharge surface over a standing wave, or meniscus, of the coating material which is as wide as the discharge surface. The coating material wets the discharge surface and a layer of coating-is deposited on the surface. Because the discharge plate has at least one ink jet nozzle, and preferably a plurality of ink jet nozzles, the coating material is naturally pulled into the nozzle by capillary force. This force increases inversely with the diameter of the ink jet nozzle. Thus, the capillary force is greater in a smaller nozzle.

Therefore, a gas pressure is applied to the ink jet head such that an opposing force to the capillary force is created at the ink jet nozzle. However, if the pressure is such that gas is blown through the coating material while the meniscus is passed over the nozzle, then bubbling will occur in the meniscus causing gross variations in the thickness of coating material being applied. Furthermore, if the pressure is great enough to cause an elevated meniscus of coating material opposing the meniscus coating system, then only a thin layer of coating material gets applied in the shadow of the elevated meniscus created by the gas. Therefore, a gas pressure in the range of about 2 inches of water pressure to about 4 inches of water pressure, and more preferably in the range of about 2.5 inches of water pressure to about 3.4 inches of water pressure, and most preferably in the range of about 2.9 inches of water pressure to about 3.1 inches of water pressure is suitable when the meniscus coating system of the aforementioned model number is used with the aforementioned coating material. The amount of pressure that needs to be applied within the ink jet head can be determined from the following formula:

$$\Delta F = \frac{2\gamma}{r}$$

Where $\gamma$ is the surface tension of the coating material, r is the radius of the nozzle, and $\Delta F$ is the difference in the force of the coating material against the discharge surface and the capillary force in the nozzle. Thus a force equal to $\Delta F$ applied from within the nozzle will compensate for the capillary force drawing material into the nozzle.

When the meniscus coating system has completely coated the discharge surface a gas pressure sufficient to blow out the coating material that is within the nozzle is applied. It has been found that a gas pressure preferably in the range of about 5 inches of water pressure to about 150 inches of water pressure, and more preferably in the range of about 30 inches of water pressure to about 100 inches of water pressure, and most preferably in the range of about 50 inches of water pressure to about 70 inches of water pressure is suitable when the meniscus coating system of the aforementioned model number is used with the aforementioned coating material.

Third, for the purpose of increasing the adhesion of the coating material to the ink jet head, the head is cured with heat. The preferred curing temperature is from about 350° C. to about 400° C. Although the manufacturer of the coating material cautions against using temperatures above 360° C. because the coating material starts to decompose, decomposing the coating material serves two very important functions. To begin with, following the application step, some of the coating material still migrates down the nozzle and forms an undesirable thin layer of between about 0 Å and about 2000 Å on the inside of the ink jet head. By decomposing the coating material for preferably at least about 5 minutes, and more preferably for at least about 10 minutes, and most preferably for at least about 15 minutes, the undesired thin layer within the ink jet head is completely decomposed, while the part of the thicker layer on the surface of the discharge surface remains. Finally, by starting the decomposition process on the coating material present on the discharge surface, greater adhesion to the surface is observed.

Although most phase change ink compositions can be employed within the scope of this invention, the preferred phase change ink compositions are those which are effective at the aforementioned elevated operating temperatures. As an example, the phase change ink composition may comprise a phase change ink carrier composition, preferably including a fatty amide-containing resin material along with a tackifier and a plasticizer, and a coloring material. The preferred fatty amide resin material is a combination of a tetraamide compound and stearyl stearamide, such as that described in U.S. Pat. No. 4,889,560, assigned to the assignee of the present invention and hereby incorporated by reference in pertinent part in so far as it is consistent with the instant disclosure.

EXAMPLE 1

An assembled ink jet head is exposed to hydrogen for about 110 minutes at about 1150° C. in a humpback furnace. The preferred method for exposing the ink jet head to the hydrogen environment is to do so as part of the process which brazes the various plates that form the head. The preferred brazing processes includes placing an ink jet head in a hydrogen environment as described in U.S. Pat. No. 4,883,219, assigned to the assignee of the present invention and hereby incorporated by reference in pertinent part in so far as it is consistent with the instant disclosure.

Within about 1 minute of exposing the head to the hydrogen environment, a smooth layer of about a 1% solution of Teflon® AF2400 (an amorphous copolymer of perfluoro(2,2-dimethyl-1,3-dioxole) and tetrafluoroethylene) in FC-40 (fluorinert solvent) is applied to the discharge surface of the ink jet head. The desired thickness of Teflon® AF2400 is between about 3000 Å and about 1000 Å. Therefore, a thickness of between about 300,000 Å and about 100,000 Å of solution is applied with a CAVEX PM4000 meniscus coating system.

The coating system is modified to include a method for applying air to the inputs of the ink jet head. Although any method can be used for applying the air to the ink jet head, one which allows the operator to maintain about 3.0 inches of water pressure at the nozzles, and then vary the pressure to about 60 inches of water pressure is required. A means may also be added to the coating system to allow the pressure changes to occur automatically. For instance, stops may be added to the coating system such that when the assembly holding the ink jet head passes by the last stop, the 60 inches of water pressure is applied to clean out the nozzles.

Figure 2A:
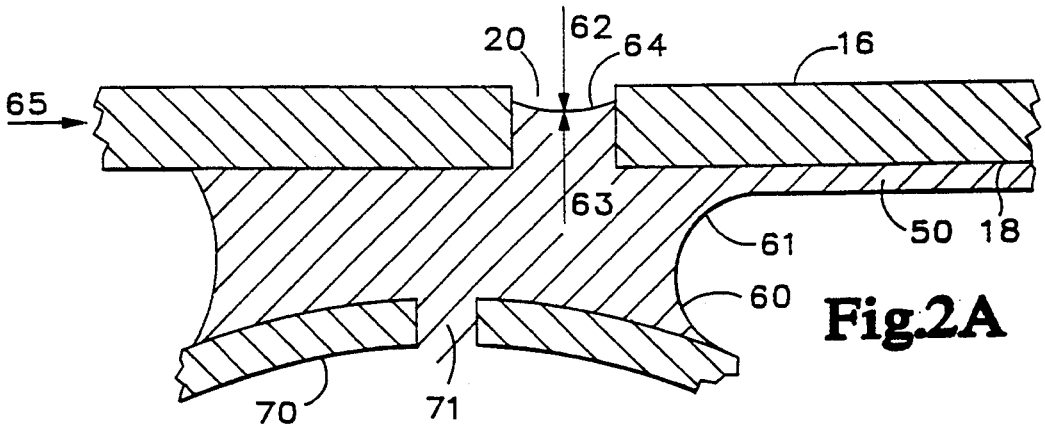
FIG. 2A is a vertical sectional view of the nozzle plate of an ink jet head as it passes over a meniscus coating system in accordance with the present invention.

Referring to FIG. 2A, Teflon® AF2400 is ejected out of applicator slot 71 of meniscus coating system 70 to form meniscus 60. As the discharge surface 18 is passed over meniscus 60, the trailing edge of the meniscus 61 forms the smooth layer of coating material 50. As the ink jet nozzle 20 passes over meniscus 60, capillary force 63 tends to draw the coating material 50 into the ink jet nozzle 20. To prevent this from occurring, air is applied to the ink jet head such that about a 3.0 inches of water pressure air pressure occurs at nozzle 20 in the direction of arrow 62. This air pressure is sufficient to oppose force 63 and an opposing meniscus 64 is formed within the nozzle.

Figure 2B:
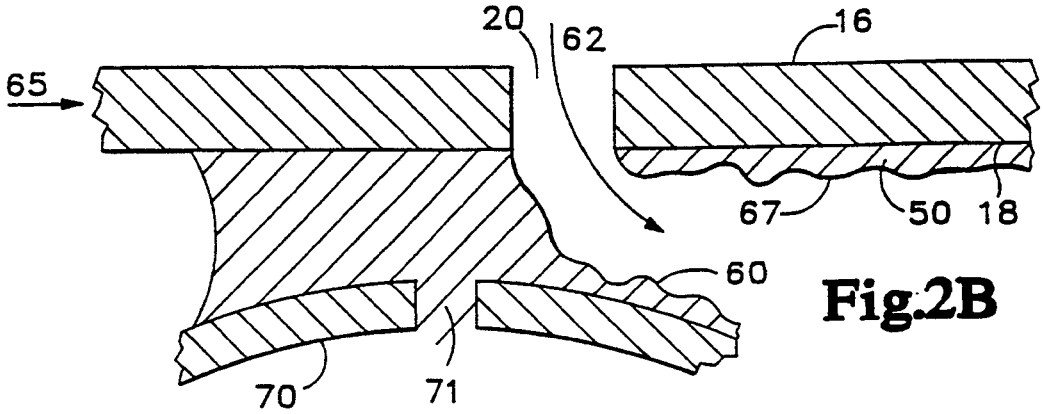
FIG. 2B is a vertical sectional view of the nozzle plate of an ink jet head as it passes over a meniscus coating system when too much gas pressure is applied from within the ink jet head.

FIG. 2B diagrams the problem that can occur if too much air pressure is applied to the ink jet head. The air pressure 62 is so great that it causes the air to pass through meniscus 60. The effect of the air passing through meniscus 60 is to cause bubbling at trailing edge 61 which creates gross variations in the thickness of coating applied 67.

Figure 3A:
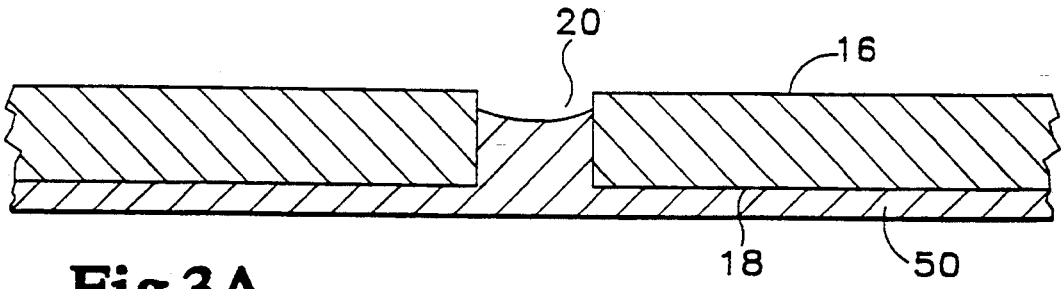
FIG. 3A is a vertical sectional view of the nozzle plate of an ink jet head after it passed over a meniscus coating system in accordance with the present invention.
Figure 3B:
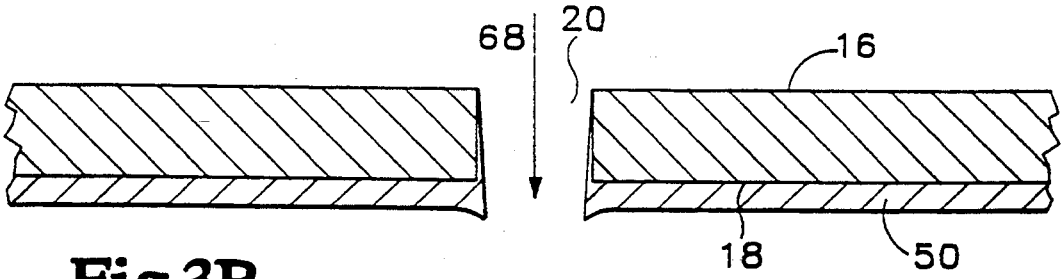
FIG. 3B is a vertical sectional view of the nozzle plate of an ink jet head after it passed over a meniscus coating system while a blast of air is applied to the ink jet head in accordance with the present invention.
Figure 3C:
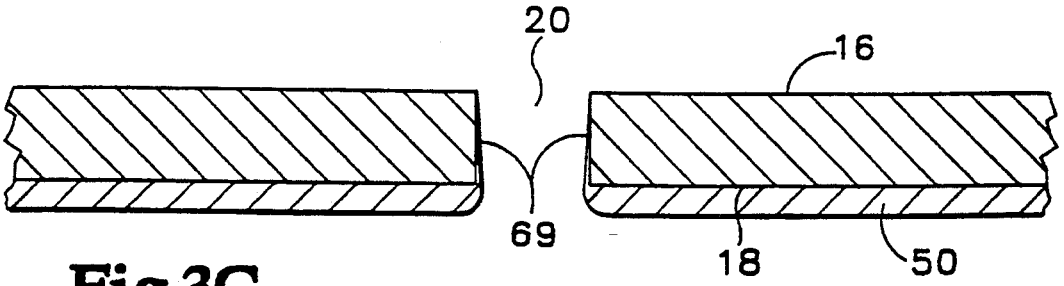
FIG. 3C is a vertical sectional view of the nozzle plate of an ink jet head after it passed over a meniscus coating system and after a blast of air is applied to the ink jet head in accordance with the present invention.

Referring to FIG. 3A, after the area of the discharge surface surrounding the nozzle has passed over the meniscus, coating layer 50 lays over nozzle 20. As shown in FIG. 3B, an air pressure 68 equal to about 60 inches of water pressure is applied to the ink jet head for at least about 1/10th of a second, but for no more than about 1 second. With the application of air, coating material 50 is removed from across nozzle 20, but a very thin layer of coating material 69 remains in the nozzle as shown in FIG. 3C.

Finally, the ink jet head is cured to promote adhesion of the coating material, and to remove any coating material within the ink jet nozzle. The Du Pont publication "Teflon® AF Product Information: Processing and Use", no. 232407B (10/92), states that the recommended molding temperature for Teflon® AF 2400 is in the range of 340° C. to 360° C. The publication further cautions that "the polymer begins to decompose above 360° C., so processing above that temperature should be avoided." However, the preferred curing temperature of the present invention is about 400° C. for about 15 minutes. By starting the decomposition of the Teflon® AF 2400, better adhesion to the discharge surface has been observed. It is theorized that the increased adhesion is due to the breaking of the Carbon-Oxygen bond within the perfluoro(2,2-dimethyl-1,3-dioxole) group. The curing process at the above recommended temperatures also decomposes the thin layer of material 69 that is in the nozzle 20 shown in FIG. 3C.

Therefore, this invention solves the problem of degrading ink contact angles at the elevated operating temperatures of a phase change ink jet head, by meniscus coating a solution of Teflon® AF on the discharge surface of a phase change ink jet print head. Furthermore, this invention solves the problem of coating materials wearing off the discharge surface of a phase change ink jet print head by applying the coating material after exposing the ink jet head to a hydrogen environment, and then curing the coating material at a temperature higher than that recommended by the coating material manufacturer. Finally, this invention solves the problems of meniscus coating a coating material to a discharge surface having at least one nozzle by applying a gas pressure to the ink jet head such that the pressure of the meniscus against the discharge surface is opposed. In this way, the coating material does not flow into the nozzle, while a smooth application of coating material is maintained.

We claim:

1. A method for modifying an ink jet head having at least one ink jet nozzle for the purpose of maintaining an increased ink contact angle between a phase change ink composition which changes from a solid phase to a liquid phase and a discharge surface of the ink jet head comprising the steps of:

applying a layer of a coating material to an area on the discharge surface surrounding the nozzle, said coating material being of sufficiently lower surface energy than the phase change ink composition to maintain an ink contact angle greater than when no coating is applied; and curing the coated surrounding area heating to a temperature which promotes decomposition of the coating material for increasing adherence of the coating material to the surrounding area, and for eliminating coating material in the ink jet nozzle.

2. A method according to claim 1, wherein the step of applying the coating is performed with a meniscus coating system such that the resultant layer of the coating material is substantially smooth to allow the ink composition to be removed from the discharge surface during a cleaning process.

3. A method according to claim 2, wherein the step of applying the coating material includes maintaining a gas pressure in the ink jet head such that the coating material does not substantially travel into the ink jet nozzle, but wherein said gas pressure is not great enough to allow the gas to pass through the coating material.

4. A method according to claim 3, wherein the step of applying the coating material includes applying a second gas pressure in the ink jet head after applying the coating material over the ink jet nozzle such that the gas blows the coating material out of the ink jet nozzle.

5. A method according to claim 4, wherein the step of applying a second gas pressure leaves a layer of coating material within the nozzle that is thin enough with respect to the layer of coating material on the discharge surface to be completely decomposed during the curing step while the layer of coating material on the discharge surface remains.

6. A method according to claim 1, wherein the surface energy of the coating material being applied is low enough to maintain an ink contact angle greater than 70° between the phase change ink composition and the discharge surface.

7. A method according to claim 1, wherein the coating material comprises a fluorinated polymeric material.

8. A method according to claim 7, wherein the polymeric material is an amorphous perfluorodioxole copolymer.

9. A method according to claim 1, wherein the curing is by heating to a temperature in excess of about 360° C.

10. A method according to claim 1, wherein the curing is by heating to a temperature in excess of about 360° C. for at least about 5 minutes.

11. A method according to claim 10, wherein the curing is by heating to a temperature in excess of about 360° C. for at least about 10 minutes.

12. A method according to claim 11, wherein the curing is by heating to a temperature in excess of about 360° C. for at least about 15 minutes.

13. A method for decreasing wetting by an ink composition of a discharge surface of an ink jet head having an ink jet nozzle comprising the steps of:

exposing the ink jet head to a hydrogen environment;

applying a layer of a coating material to an area on the discharge surface surrounding the nozzle while the discharge surface is still reactive with the coating material due to exposure to the hydrogen environment; and curing the layer of coating material by heating to a temperature which promotes decomposition of the coating material for increasing adherence of the coating material to the surrounding area, and for eliminating the coating material in the ink jet nozzle.

14. A method according to claim 13, wherein the step of exposing the ink jet head to the hydrogen environment occurs during a bonding process of a plurality of components of the ink jet head.

15. A method according to claim 13, wherein the step of applying the coating material occurs less than one hour from the step of exposing the ink jet head to the hydrogen environment.

16. A method according to claim 13, wherein the coating material comprises a fluorinated polymeric material.

17. A method according to claim 16, wherein the polymeric material is an amorphous perfluorodioxole copolymer.

18. A method according to claim 13, wherein the step of applying the coating is performed with a meniscus coating system such that the resultant layer of the coating material is substantially uniform to allow the ink composition to be removed from the discharge surface during a cleaning process.

19. A method according to claim 18, wherein the step of applying the coating material includes maintaining a gas pressure in the ink jet head such that the coating material does not substantially travel into the ink jet nozzle, but wherein said gas pressure is not great enough to allow the gas to pass through the coating material.

20. A method according to claim 19, wherein the step of applying the coating material includes the application of a second gas pressure in the ink jet head after applying the coating material over the ink jet nozzle such that the gas blows the coating material out of the ink jet nozzle.

21. A method according to claim 20, wherein the step of applying a second gas pressure leaves a layer of coating material within the nozzle that is thin enough with respect to the layer of coating material on the discharge surface to be completely decomposed during the curing step while the layer of coating material on the discharge surface remains.

22. A method according to claim 13, wherein the curing is by heating to a decomposition temperature of the coating material.

23. A method according to claim 22, wherein the curing is by heating to a temperature in excess of about 360° C.

24. A method according to claim 13, wherein the discharge surface of the ink jet head is exposed to the hydrogen environment for at least about 50 minutes.

25. A method according to claim 13, wherein the discharge surface of the ink jet head is exposed to the hydrogen environment at a temperature at least about 500° C.

26. A method according to claim 13, wherein the discharge surface of the ink jet head is exposed to the hydrogen environment at a temperature at least about 800° C.

27. A method according to claim 13, wherein the discharge surface of the ink jet head is exposed to the hydrogen environment at a temperature at least about 1100° C.

28. A method for improving both the adherence of a non-wetting material to a discharge surface of an ink jet head having an ink jet nozzle, and the non-wetting properties of the non-wetting material comprising the steps of:

applying an adhesion promoting layer to an area on the discharge surface surrounding the nozzle;

applying a substantially smooth layer of the non-wetting material to the area on the discharge surface surrounding the nozzle to allow a phase change ink composition to be removed from the discharge surface during a cleaning process; and curing by heating the coated surrounding area to a decomposition temperature of the non-wetting material for increasing adherence of the non-wetting material to the surrounding area, and for eliminating the non-wetting material in the ink jet nozzle.

29. A method according to claim 28, wherein the step of applying the adhesion promoting layer includes applying a compound selected from the group consisting of a polyimide and a polyetherketone.

30. A method according to claim 28, wherein the step of applying the non-wetting material includes maintaining a gas pressure in the ink jet head such that the non-wetting material does not substantially travel into the ink jet nozzle, but wherein said gas pressure is not great enough to allow the gas to pass through the non-wetting material.

31. A method according to claim 30, wherein the step of applying the non-wetting material includes the application of a second gas pressure in the ink jet head after applying the non-wetting material over the ink jet nozzle such that the gas blows the non-wetting material out of the ink jet nozzle.

32. A method according to claim 31, wherein the step of applying a second gas pressure leaves a layer of non-wetting material within the nozzle that is thin enough with respect to the layer of non-wetting material on the discharge surface to be completely decomposed during the curing step while the layer of coating material on the discharge surface remains.

33. A method according to claim 28, wherein the curing is by heating to a temperature in excess of about 360° C.

34. A method according to claim 28, wherein the discharge surface of the ink-jet is exposed to a hydrogen environment prior to applying the adhesion promoting layer.

35. A method according to claim 33, wherein the curing is by heating to a temperature in excess of about 360° C. for at least about 5 minutes.

36. A method according to claim 35, wherein the curing is by heating to a temperature in excess of about 360° C. for at least about 10 minutes.

37. A method according to claim 36, wherein the curing is by heating to a temperature in excess of about 360° C. for at least about 15 minutes.

38. A method according to claim 34, wherein the discharge surface of the ink jet head is exposed to the hydrogen environment at a temperature at least about 500° C.

39. A method according to claim 38, wherein the discharge surface of the ink jet head is exposed to the hydrogen environment at a temperature at least about 800° C.

40. A method according to claim 39, wherein the discharge surface of the ink jet head is exposed to the hydrogen environment at a temperature at least about 1100° C.

41. A method according to claim 34, wherein the discharge surface of the ink jet head is exposed to the hydrogen environment for at least about 50 minutes.

* * * * *